343-700 MS AU 251 EX
5/22/84 OR 4,450,449

United States Patent [19]
Jewitt

[11] 4,450,449
[45] May 22, 1984

[54] PATCH ARRAY ANTENNA

[75] Inventor: Harold S. Jewitt, Hennepin County, Minn.

[73] Assignee: Honeywell Inc., Minneapolis, Minn.

[21] Appl. No.: 352,490

[22] Filed: Feb. 25, 1982

[51] Int. Cl.[3] ..... H01Q 1/38
[52] U.S. Cl. ..... 343/700 MS; 343/846
[58] Field of Search ..... 343/700 MS, 829, 830, 343/846, 853

[56] References Cited

U.S. PATENT DOCUMENTS 3,757,342 9/1973 Jasik et al. ..... 343/700 MS
4,101,895 7/1978 Jones ..... 343/700 MS

*Primary Examiner*—Eli Lieberman
*Attorney, Agent, or Firm*—George W. Field

[57] ABSTRACT

An antenna comprising, in combination: a first nonconductive substrate; a conductive ground plane on one surface of the substrate; a plurality of conductive patches mutually spaced in an array extending over the other surface of the substrate; conductors for energizing said patches to comprise a first antenna with said ground plane; a second nonconductive substrate overlying said plurality of patches; a second plurality of conductive patches mutually spaced in a second array extending over the outer surface of the second substrate, and positioned in the spaces between the patches of the first array; and conductors for energizing the second plurality of patches to comprise a second antenna with said ground plane.

6 Claims, 4 Drawing Figures

PATCH ARRAY ANTENNA

TECHNICAL FIELD

This invention relates to the field of electronics, particularly to the design of a crosspolarized antenna in planar form.

BACKGROUND OF THE INVENTION

Patches, used in arrays as microwave or millimeter wave power radiators, are a well established method of achieving planar, that is, thin, printed circuit antennas. Such antennas have been two-dimensional, that is, they have used one surface of an insulative substrate as the array of patches and the other surface as the required ground plane.

This requires that for multiple polarization arrays, the patches be fed and radiate both polarizations simultaneously, and little success has been achieved in doing this. Multiple frequency or multiple beam arrays are virtually impossible.

SUMMARY OF THE INVENTION

The present invention introduces a third dimension, thickness, to the array design. Separate substrate layers are etched to produce two individual patch arrays, and are then bonded together so that the patches of the rear array are behind the open spaces of the front array. For the dual polarization case, each of the arrays is fed orthogonally without any requirement that each patch radiate both polarizations. Similarly, for multiple frequency antennas, one array may radiate at a first frequency and be optimally designed for that frequency, while the other array radiates at and is designed for a second frequency. Multiple beam arrays are similarly possible. By suitably designing the array and its leads beam steering by frequency shift is also possible.

Various advantages and features of novelty which characterize the invention are pointed out with particularity in claims annexed hereto and forming a part hereof. However, for a better understanding of the invention, its advantages and objects attained by its use, reference should be had to the drawing which forms a further part hereof, and to the accompanying descriptive matter, in which there are illustrated and described certain preferred embodiments of the invention.

BRIEF DESCRIPTION OF THE DRAWING

In the drawing, in which like reference numerals indicate corresponding parts throughout the several views.

DESCRIPTION OF THE PREFERRED EMBODIMENT

Figure 1:
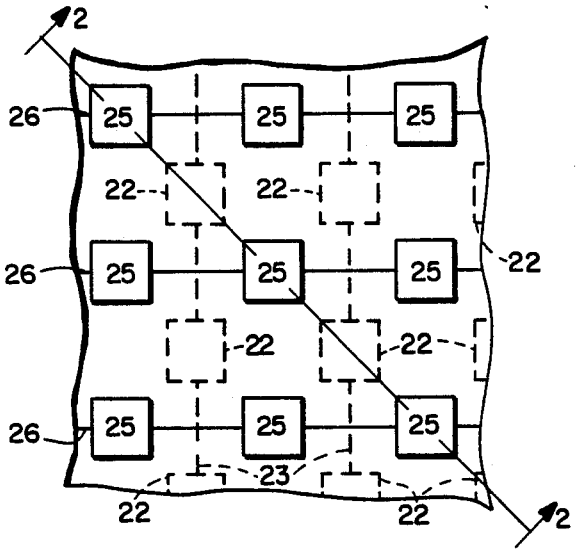
FIG. 1 is a fragmentary view in elevation of a portion near the center of an antenna according to the invention.

One embodiment of an antenna according to the invention is shown to comprise a first, thin substrate 20 of insulating material, such as "Duroid," having on its rear surface a conductive layer 21 of material such as copper to act as a ground plane. The front surface of substrate 20 has an array of patches 22 of conductive material, provided with energization through conductors 23.

A second substrate 24 without a ground plane overlies patches 22 and has on its outer surface an array of patches 25 of conductive material, provided with energization through conductors 26. The patches of the second array are displaced from those of the first array to radiate through the spaces therebetween. Conductive layer 21 acts as a ground plane for the patches of both arrays.

Certain modifications of the structure thus described may be desirable. For example, substrates 20 and 24 may be of the same or of different thickness.

Figure 2:
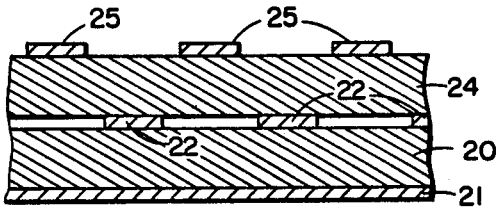
FIG. 2 is a fragmentary sectional view generally along the line 2—2 of FIG. 1, and FIGS. 3 and 4 are views like FIG. 2 showing modifications of the invention.
Figure 3:
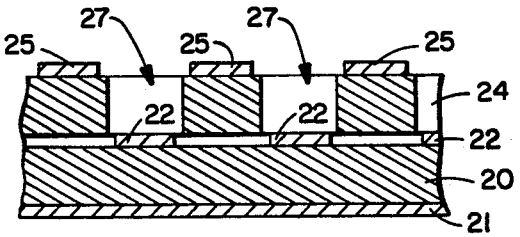
Figure 4:
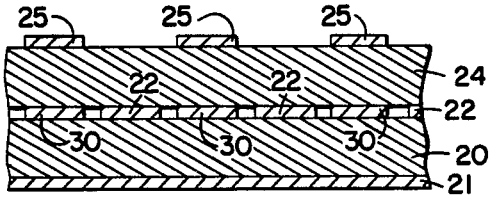

If the front array insulant is punched away in line with the back array patches, as suggested at 27 in FIG. 3, better performance of the back array may be obtained. Also, the band widths of the two arrays are not the same in the construction of FIGS. 1 and 2, because the insulant thickness of the front array is twice that of the back array. This may be avoided by providing the second substrate with its own ground plane of electrically interconnected patches 30 aligned with patches 25, as suggested in FIG. 4.

From the above it will be evident that the invention comprises an antenna having a plurality of patch arrays which may simultaneously radiate separately at different frequencies or at different polarizations, thus minimizing upper-to-lower patch interference, loading and cross-talk.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the scope of the invention, to the full extent indicated by the broad general meaning of the terms in which the appended claims are expressed.

The embodiments of the invention in which an exclusive property or right is claimed are defined as follows:

1. An antenna comprising, in combination:
   - a first nonconductive substrate;
   - a conductive ground plane on one surface of said substrate;
   - a plurality of conductive patches mutually spaced in an array extending over the other surface of said substrate;
   - means for conductively energizing said patches to comprise a first antenna with said ground plane;
   - a second nonconductive substrate overlying said plurality of patches;
   - a second plurality of conductive patches mutually spaced in a second array extending over the outer surface of said second substrate, and positioned in the spaces between the patches of said first array;
   - and means for conductively energizing said second plurality of patches to comprise a second antenna with said ground plane.

2. An antenna according to claim 1 in which said second substrate includes apertures in line with the patches of said first array.

3. An antenna according to claim 1 in which said second substrate includes a ground plane comprising a further plurality of conductive patches aligned with the pathces of said second array.

4. An antenna according to claim 1 in which said arrays are fed with inputs of different polarizations.

5. An antenna according to claim 1 in which said arrays are energized with inputs of different frequencies.

6. An antenna according to claim 1 in which said substrates are of the same thickness.

* * * * *